US011136762B2

(12) United States Patent
Breyer

(10) Patent No.: US 11,136,762 B2
(45) Date of Patent: Oct. 5, 2021

(54) FASCIA-MOUNTED GUTTER DEBRIS BARRIER SYSTEM

(71) Applicant: All Weather Armour, LLC, Sullivan, WI (US)

(72) Inventor: Scott Breyer, Jefferson, WI (US)

(73) Assignee: All Weather Armour, LLC, Sullivan, WI (US)

( * ) Notice: Subject to any disclaimer, the term of this patent is extended or adjusted under 35 U.S.C. 154(b) by 0 days.

(21) Appl. No.: 16/263,754

(22) Filed: Jan. 31, 2019

(65) Prior Publication Data

US 2019/0234075 A1 Aug. 1, 2019

Related U.S. Application Data

(60) Provisional application No. 62/624,222, filed on Jan. 31, 2018.

(51) Int. Cl.
*E04D 13/076* (2006.01)

(52) U.S. Cl.
CPC ..... *E04D 13/076* (2013.01)

(58) Field of Classification Search
CPC ..... E04D 13/076
See application file for complete search history.

(56) References Cited

U.S. PATENT DOCUMENTS 5,010,696 A 4/1991 Knittel
7,310,912 B2 12/2007 Lenney et al.
7,765,742 B2 8/2010 Ealer, Sr.
7,975,435 B2 7/2011 Lenney et al.
8,079,183 B2 12/2011 Lenney
8,438,787 B2 5/2013 Lenney
8,479,454 B2 7/2013 Lenney et al.
8,756,868 B2 * 6/2014 McCoy ..... E04D 13/076 52/12
8,997,403 B1 * 4/2015 Steinberg ..... F16M 13/02 52/11
9,021,747 B2 5/2015 Lenney et al.
9,487,955 B2 11/2016 Breyer et al.
9,890,535 B2 2/2018 Breyer et al.
2006/0101722 A1 5/2006 Ealer, Sr.
2006/0123710 A1 * 6/2006 Lenney ..... E04D 13/076 52/12

(Continued)

OTHER PUBLICATIONS

Flyer from Lynch Aluminum Mfg. Co. for Klynch Channel The Single Saver.

*Primary Examiner* — Babajide A Demuren
(74) *Attorney, Agent, or Firm* — Boyle Fredrickson S.C.

(57) ABSTRACT

A gutter debris barrier system is provided that includes a frame that is configured for direct attachment to a building and a filter screen for preventing debris from entering a gutter while allowing water to flow therethrough. The frame may include a floor with slots punched therein, with ribs on either side of the slots that form channels. The channels may be tapered to improve the speed and efficiency of heat transfer, and also to funnel water down into the gutter. The frame is made of a durable material, such as extruded aluminum. The frame has a first mounting flange that can bend and flex relative to the remaining portions of the frame, which allows for enough flexibility to enable the frame to be mounted directly to the building.

18 Claims, 4 Drawing Sheets

(56) References Cited

U.S. PATENT DOCUMENTS

| | | | | |
|---|---|---|---|---|
| 2010/0287846 | A1* | 11/2010 | Lenney | E04D 13/0762 52/12 |
| 2011/0067318 | A1 | 3/2011 | Lenney et al. | |
| 2013/0248672 | A1 | 9/2013 | Martin | |
| 2014/0215929 | A1* | 8/2014 | Lenney | E04D 13/076 52/12 |
| 2015/0020462 | A1 | 1/2015 | Iannelli | |
| 2015/0354226 | A1* | 12/2015 | Lenney | E04D 13/076 52/12 |
| 2016/0060870 | A1* | 3/2016 | Martin | E04D 13/064 52/12 |
| 2016/0068070 | A1 | 3/2016 | Huang et al. | |
| 2016/0102459 | A1 | 4/2016 | Breyer | |
| 2016/0168859 | A1* | 6/2016 | Vargas | E04D 13/158 52/716.2 |
| 2017/0009456 | A1* | 1/2017 | Lenney | E04D 13/076 |
| 2017/0044771 | A1* | 2/2017 | Breyer | E04D 13/076 |

* cited by examiner

FASCIA-MOUNTED GUTTER DEBRIS BARRIER SYSTEM

CROSS-REFERENCE TO RELATED APPLICATIONS

The present application claims priority on U.S. Provisional Patent Application Ser. No. 62/624,222, filed on Jan. 31, 2018 and entitled Fascia-Mounted Gutter Debris Barrier System, the entirety of which is hereby incorporated herein by reference.

BACKGROUND OF THE INVENTION

1. Field of the Invention

The present invention relates to gutter debris barrier systems, also known as gutter guards, which are placed on or about rain gutters located adjacent to a roof of a building to permit the passage of water while preventing debris from entering into and collecting in the gutter.

2. Discussion of the Related Art

A common problem with rain gutters is that they become clogged or jammed with various debris including leaves, needles, shingle sand, and other materials that fall onto the gutter. Functionality of the rain gutter is dramatically decreased once debris enters the gutter. Consequently, a property owner is required to repeatedly clean out rain gutters over the course of a year. To address this issue, gutter debris barrier systems, or gutter guards, have been introduced to prevent debris from collecting within the gutter. The goal of gutter guards is to prevent debris from entering the gutter while still maintaining water flow through the gutter guard and into the gutter, such that water is not dripping down the outside of the gutter, and ultimately the building.

The most primitive debris barrier systems consist of a guard that simply included a screen with multiple holes that is laid across the gutter. These systems attempted to balance the need for holes large enough for sufficient flow of water while small enough to prevent debris from flowing through the screen. Over time, more sophisticated guard systems were developed. For instance, mesh filter elements have been used with sufficiently small holes to allow the flow of water therethrough. These mesh filter elements often are supported by a frame that includes channels and holes to guide the flow of water down into the gutter. These systems block substantially all debris from entering while allowing high volumes of water to pass through to the gutter. U.S. Pat. No. 7,310,912, which is incorporated herein by reference in its entirety, discloses such a system.

Additionally, some rather primitive debris barrier systems include frames that are capable of being mounted directly to the fascia of a building. These frames are made of pliable, flexible materials such as stamped metal or plastic. By using a flexible and pliable material, these frames were capable of flexing and bending upon themselves, which is important to allow a first end of the frame to be mounted to the gutter, and the second end to be mounted to the stationary fascia. This flexing and bending is necessary to account for variations in the shape of the gutter, the fascia, and/or other aspects of the building. For instance, the distance between the fascia and the lip of the gutter may vary from gutter to gutter as a result of the way in which the gutter is mounted to the building. Similarly, the overall slope of the gutter and/or of the fascia could vary. Thus, in order for the system to securely be attached directly to the fascia and to the gutter, the system needs to be able to flex or bend to accommodate these and any other variations and irregularities in the shape of the gutter and/or the building. The flexibility of the material is helpful for mounting to the fascia. Unfortunately, the low quality of the materials frequently results in the unintended warping, bending, or failure of the frame. These defects cause, amongst other problems, bulges and waves to form in the screen, which can hinder efficient flow of water through the screen and frame and into the gutter. In severe cases the screen can even pull away from the frame leaving a gap for debris to enter the gutter its self, rendering the expensive gutter guard investment useless.

Some micro-screen gutter guards have a frame only on each of its opposed ends and use a "ribbed" screen for structural support between those ends. Besides lacking the stability provided by a system having a frame running length of the system, the screen never touches any part of the frame along the vast majority of its length. This absence of contact substantially hinders the passage of water through the screen because capillary action that otherwise would occur due to contact between screen and the frame is absent in several places. Without this capillary action, water flows over the edges of the gutter rather than through the screen and creates unsightly vertical "tiger stripes" on the outside surface of the gutter.

The problems associated with primitive flimsy gutter systems have been largely eliminated with the development of more heavy-duty gutter guards that were made of durable materials, such as extruded aluminum. Such systems are disclosed, for example, in U.S. Pat. Nos. 8,079,183 and 8,438,787, which are incorporated herein by reference in their entirety. The gutter debris barrier system disclosed in these patents features a rigid frame with a filter element supported above the frame. One side of the frame is mounted beneath the shingles of the roof, and the other side is attached to the lip of the outer wall of the gutter. Longitudinally extending ribs are located within the frame, with slotted channels being formed between the ribs for the direction of water into the underling gutter. The ribs are generally rectangular when viewed in transverse cross section, and their sides thus extend generally perpendicularly from the floor of the frame. Activation of an optional heating element located adjacent to the frame heats the frame, the filter element, the flange, and the gutter.

Even more refined gutter systems are disclosed in U.S. Pat. Nos. 9,487,955 and 9,890,535, which are incorporated herein by reference in their entirety. The gutter debris barrier system disclosed in these patents feature a frame and a filter screen that rests upon the frame. The system may also include a heating element. The frame includes at least three channels formed by ribs and slots formed therebetween. As a result, the system features a thermal heat path that may have an uninterrupted serpentine path from one side of the frame to the other. This minimizes the distance of the thermal transfer path while maximizing efficiency of heat transfer from the heating element to the frame. Additionally, the ribs may extend from a floor to a truncated peak to form upwardly-facing u-shaped channels. Because the ribs have truncated peaks, a planar upper surface is formed, upon which the filter may rest. The system may also include a mounting bracket configured to secure the frame to the gutter. More specifically, the mounting bracket may include a C-bracket that is configured to receive a flange of the frame. This C-bracket allows for inward and outward movement of the flange relative to the bracket.

These heavy duty-frame based gutter systems thus are more effective and reliable than earlier, relatively flimsy systems. However, the rigid frames of these system could not be directly mounted to a building's fascia because of the very lack of flexibility that makes them superior to earlier systems in so many ways. Brackets therefore were required to mount these gutter systems on buildings.

The need thus has arisen to provide a gutter system having a frame that is sturdy, dimensionally stable where it is desirable to exhibit such stability and rigidity, and which exhibits sufficient flexibility at least along one side thereof to be directly mountable on a building's fascia or other surface.

SUMMARY OF THE INVENTION

In accordance with an aspect of the present invention, a debris barrier system includes a frame adapted to overlie at least a portion of the gutter and a filter screen that covers at least a portion of the frame. The frame is made of a durable metallic material such as extruded aluminum and includes a first side that is sufficiently flexible to permit mounting of the frame directly to a fascia or similar surface of a building and a second side that supports the gutter. The term "directly", as used herein, means without the need for brackets or clips that can accommodate irregularities in the mounting surface of the building and/or in the gutter and/or between the gutter and that mounting surface. The filter screen may cover at least a portion of the frame to allow for water to flow therethrough while precluding debris from passing therethrough.

In accordance with another aspect of the invention, the first side of the frame may include a first mounting flange. The first mounting flange may extend from the frame at any of a variety of angles, including extending substantially perpendicular from the bottom of the gutter or at an obtuse angle relative to the bottom of the gutter. In either embodiment, the first mounting flange may be configured to be fastened to the fascia. Additionally, the first side of the frame may also include a horizontal base portion that extends from a first side of the frame to the first mounting flange.

The thickness of the horizontal base portion may vary across its length. For instance, the thickness of the horizontal base portion may decrease progressively or stepwise from a first thickness at a first side of the frame to a second thickness at the first mounting flange. Thus, the first thickness is greater than the second thickness. The second side thus is more flexible than the first side.

Further still, the thickness of the first mounting flange may be substantially equal to the second thickness. For instance, the first mounting flange may have a thickness of 0.045 inches. In addition to the first mounting flange, the frame may also have a second mounting flange that extends from the second side of the frame to run substantially parallel with the bottom of the gutter. The second mounting flange may be fastened to a second wall of the gutter opposite the fascia.

In accordance with another aspect of the invention, the frame can also have a living hinge instead of or in addition to being of varying thickness along its width. Such a living hinge may be located where the horizontal base portion and the first mounting flange intersect. The living hinge may be configured to enable the first mounting flange to flex or bend in either direction, while the horizontal base portion remains in place. The horizontal base portion and the first mounting flange may have substantially the same thickness, with the living hinge being made of a material or specifically shaped to enable the first mounting flange to pivot. For instance, the living hinge could take the form of a cutout section or groove that enables the first mounting flange to flex or bend, or the living hinge may be made out of a material that enables the first mounting flange to flex or bend relative to the horizontal base portion.

In accordance with another aspect of the system, the frame includes a floor with at least two longitudinally extending, laterally spaced tapered channels extending between the first side and the second side. These channels may be separated by a rib that extends upwardly from the floor. The channels may be generally arcuate in transverse cross section, and the rib may have first and second opposed surfaces which slope curvilinearly downwardly towards the respective channels. The floor of the frame may have slots punched within the channels to allow water to pass through the frame and into the underlying gutter. The slots may be located along a lowest point of each channel to encourage water passage therethrough.

In accordance with yet another aspect of the invention, a method of installation of the debris barrier system is provided. The method includes the steps of attaching a first mounting flange directly to a building surface, the first mounting flange extending outwardly from an inner side of a metal frame, locating a second mounting flange to the second wall of the gutter, the second flange extending inwardly from an outer side of the metal frame, and attaching the second mounting flange to the second wall of the gutter.

The method may include the step of bending the frame about a location disposed between inner and outer edges of the first mounting so that the second mounting flange abuts the second wall of the gutter.

Further still, the method may include the step of bending the frame about the pivot point at least 15 degrees until the second mounting flange abuts the second wall of the gutter.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION

Figure 1:
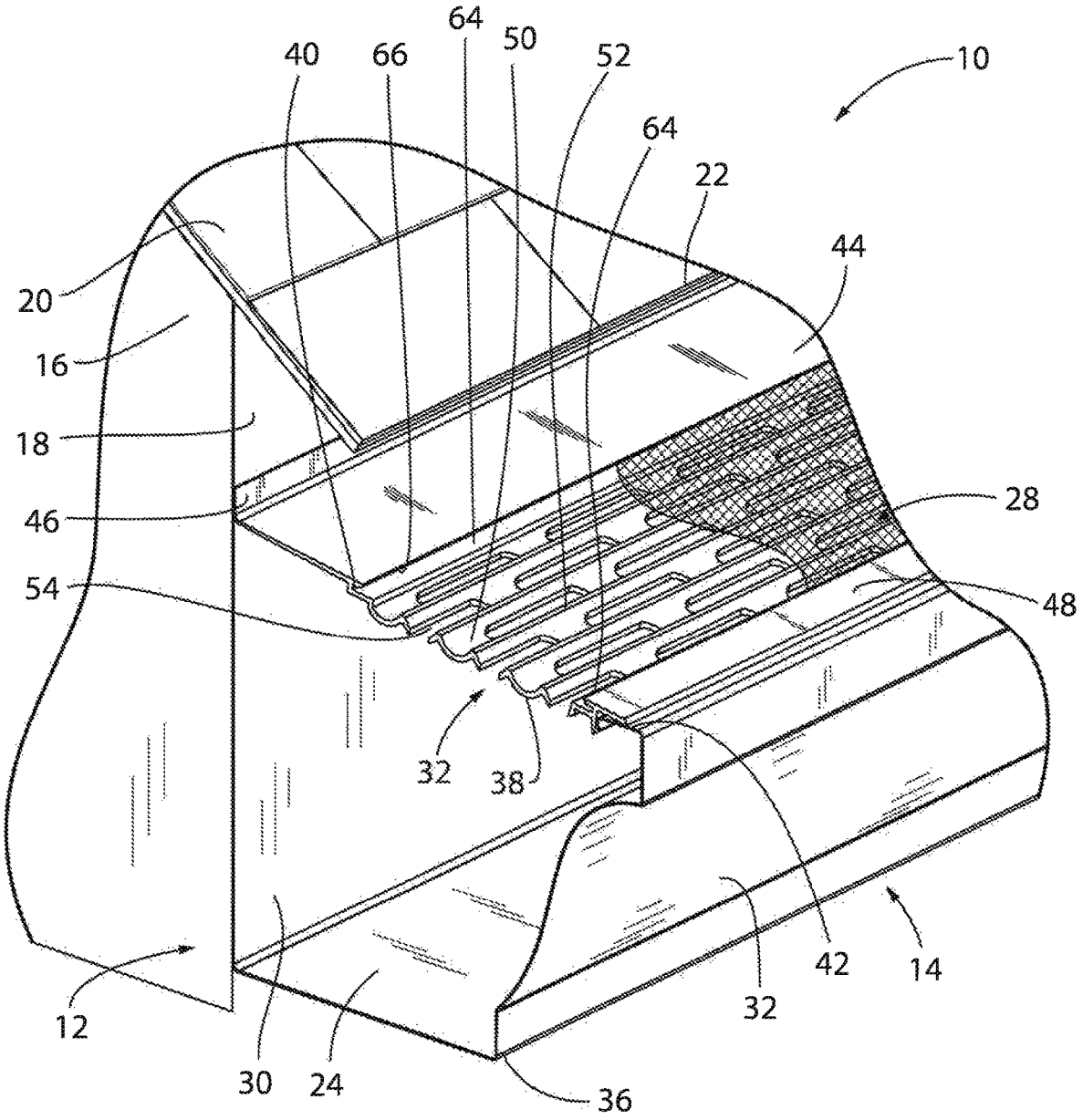
FIG. 1 is a top perspective view of a gutter debris barrier system constructed in accordance with the invention and installed above a gutter.

Referring now to the drawings, a gutter debris barrier system 10 as mounted on a building 12 about a gutter 14, a roof 16, and a fascia 18 is shown. The fascia 18 extends downwardly from the roof 16. The roof 16 is covered on the top by shingles 20 and has a drip lip 22 that extends beyond the fascia 18. The gutter 14 is mounted to the building 12 adjacent the fascia 18. The gutter debris barrier system 10 is mounted over a bottom 24 of the gutter 14 and includes a frame 26 located and supported at its inside on the fascia 18 and at its outside on the gutter 14, and a filter screen 28 is supported on the frame 26.

Figure 2:
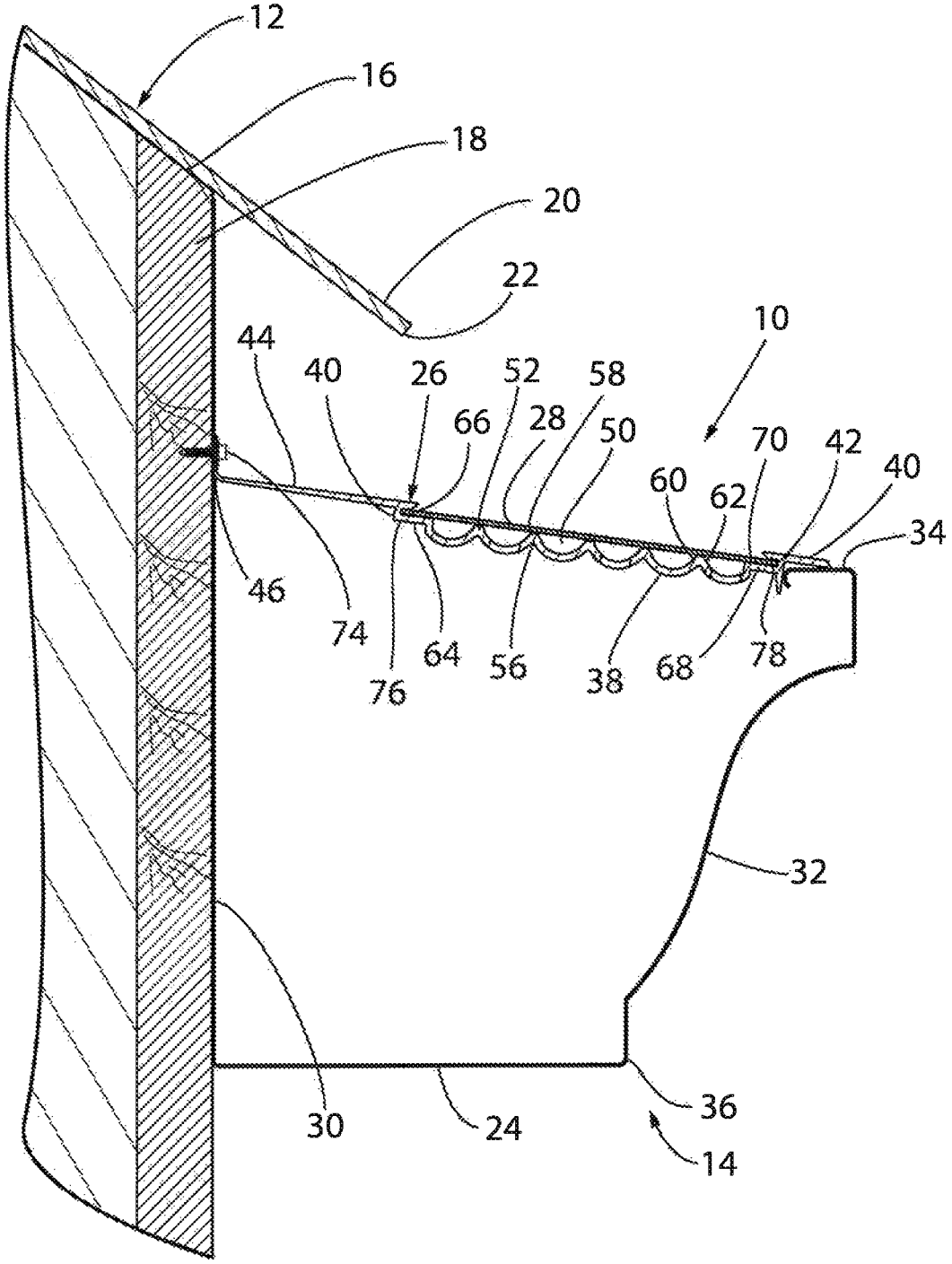
FIG. 2 is a cross sectional end elevation view of the gutter debris barrier system of FIG. 1.

Looking to FIGS. 1 and 2, the gutter 14 is generally trapezoidal in transverse cross section and includes the bottom 24, an inner wall 30 positioned adjacent the fascia 18, and an outer wall 32 having an upper lip 34. The inner wall 30 typically extends substantially vertically, while the outer wall 32 generally is inclined upwardly away from the outer edge 36 of the bottom 24 of the gutter 14. The gutter 14 is mounted on the fascia 18 by brackets and hangers, not shown. The gutter 14 typically will be 5" to 6" wide at its upper end and about 5" to 6" deep.

The gutter debris barrier system 10 of the illustrated embodiment includes a frame 26 that is located above the bottom 24 of the gutter 14 and a filter screen 28 supported on the frame 26 and having openings sized to allow water to pass through while preventing debris from entry. The frame 26, or a number of frames attached end to end, extend the entire length of the gutter 14. As shown, the system 10 can be mounted to the fascia 18 and on the gutter 14 without interfering with the roof 16 or the shingles 20. Once mounted in place, the system 10 protects the gutter 14 from debris such as leaves and pine needles, while still allowing water to pass through down into the bottom 24 of the gutter 14.

Figure 3:
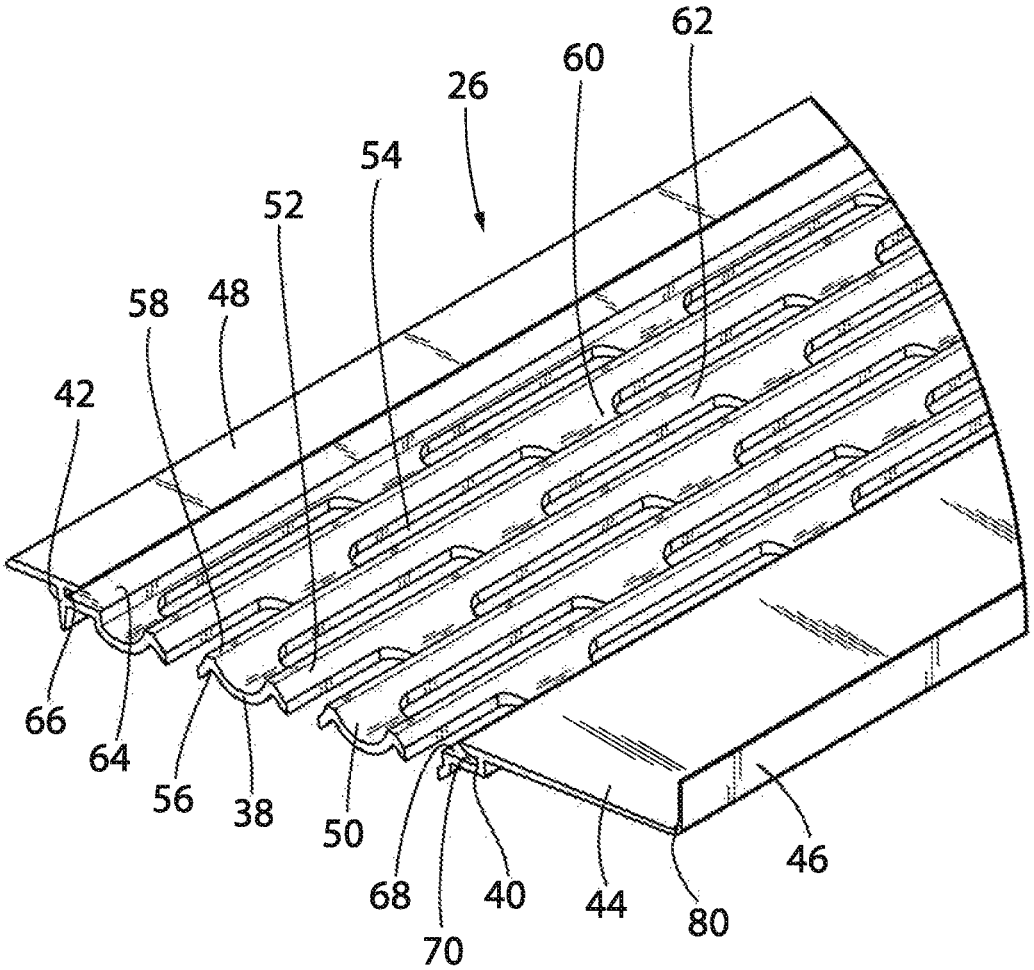
FIG. 3 is a top perspective view of a section of a frame of the gutter debris barrier system of FIGS. 1 and 2.

One embodiment of the frame 26 is illustrated in greater detail in FIGS. 1-3. The frame 26 is formed from a relatively rigid metal material that may additionally be heat conductive if the gutter is to be heated. Extruded aluminum is one such material This relatively rigid construction is more durable and dimensionally stable than flexible frames of the prior art, such as those made of pressed sheet metal or plastic, that are mounted directly to a fascia. Other rigid materials could similarly be used, including coated steel. While allowing for the flexibility traditionally required to mount a frame directly to a fascia, these sheet metal frames are prone to undesirable warping and bending during or after installation, which can make it more difficult for water to be moved downwardly into the gutter.

The frame 26 includes a floor 38 with a first, inner side wall 40 and a second, outer side wall 42, all of which extend longitudinally of the gutter 14 once the frame 26 is mounted in place. A horizontal base portion 44 extends inwardly from the upper edge of the first, inner side wall 40 to a first mounting flange 46. The base portion 44 and flange 46 may be formed integrally with each other and with the remainder of the frame 26 as shown or, alternatively, may be provided as one or individual components attached to each other and to the remainder of the frame 26. In the illustrated embodiment, the first mounting flange 46 extends at an obtuse angle relative to the horizontal base portion 44. That angle may be on the order of 95 degrees to 110 degrees and, more typically, of about 98 degrees. In other embodiments, the first mounting flange 46 may extend substantially perpendicular from the horizontal base portion 44. It should be noted that the first mounting flange 46 could similarly extend away from the horizontal base portion 44 at different angles to be mounted to the building 12 at various angles relative to the fascia 18 and/or to accommodate fascia that do not extend vertically while assuring that a line extending transversely across the flanges 46 and 48 lies in a horizontal plane.

Regardless of the angle at which the first mounting flange 46 extends from the horizontal base portion 44, the first mounting flange 46 is capable of flexing towards or away from the horizontal base portion 44 in order for it to securely be mounted to the fascia 18 without compromising the strength of the frame 26. For instance, the frame 26 can be securely mounted to the fascia 18 and gutter 14 despite variations in the way the gutter 14 is mounted, the location of the outer wall 32 of the gutter 14, the distance between the gutter 14 and the fascia 18, the slope of the gutter 14 and its outer wall 32, the slope of the fascia 18, and any other variations in the gutter 14, the building 12, and the fascia 18. Previously, a frame having this level of adaptability would be made of a flimsy material such as stamped sheet metal that is prone to bending, twisting, and failure during or after the installation to the gutter as described above.

This flexing of the first mounting flange 46 can occur in a few different ways. Still looking to FIGS. 1-3, the desired flexing may occur in light of the thickness of the first mounting flange 46 and the horizontal base portion 44. In the present embodiment, the frame 26 includes a horizontal base portion 44 having an area of reduced thickness and, consequently, enhanced flexibility, than other portions of the frame 26. More specifically, as shown, the horizontal base portion 44 is thicker at a first end where the horizontal base portion 44 extends from the inner side wall 40 than at a second end where the horizontal base portion 44 meets the first mounting flange 46. For instance, the thickness of the horizontal base portion 44 at the inner side wall 40 may be between 0.04-0.08 inches and, more typically, 0.06 inches. The thickness of the horizontal base portion 44 of this embodiment decreases progressively and uniformly from the inner side wall 40 to the first mounting flange 46. Where the horizontal base portion 44 meets the first mounting flange 46, the thickness of the horizontal base portion 44 has a thickness between 0.01-.0.06 inches and, more typically, 0.060 inches. It should be noted that this variation in thickness need not be uniform across the width of the flange 46 but, instead, could proceed in discrete step or a non-linear curve from the outer to inner edges of the flange 46.

Additionally, the first mounting flange 46 may have a similar thickness as the thickness of the horizontal base portion 44 where the two meet. As shown, the first mounting flange 46 may have a thickness between 0.01-0.06 inches and, more typically, 0.045 inches. Because the horizontal base portion 44 and the first mounting flange 46 have a thinner cross section in comparison to the other portions of the frame 26, the horizontal base portion 44 and the first mounting flange 46 can flex and bend slightly to help facilitate installation onto the fascia 18 of the building 12 without compromising the overall strength of the frame 26.

For instance, the first mounting flange 46 can bend at least 15 degrees in either direction. More preferably, the first mounting flange 46 can bend at least 20 degrees in either direction. Further still, the first mounting flange 46 can bend even further, for instance up to 90 degrees in either direction such that the first mounting flange 46 is substantially parallel with the frame 26 or the first mounting flange 46 is substantially perpendicular with the frame 26. While the frame 26 has sufficient rigidity, it preferably can be bent as described above by an adult individual using the force of a hand. The frame 26 therefore is sturdy yet is sufficiently flexible to accommodate installation variables.

Figure 4:
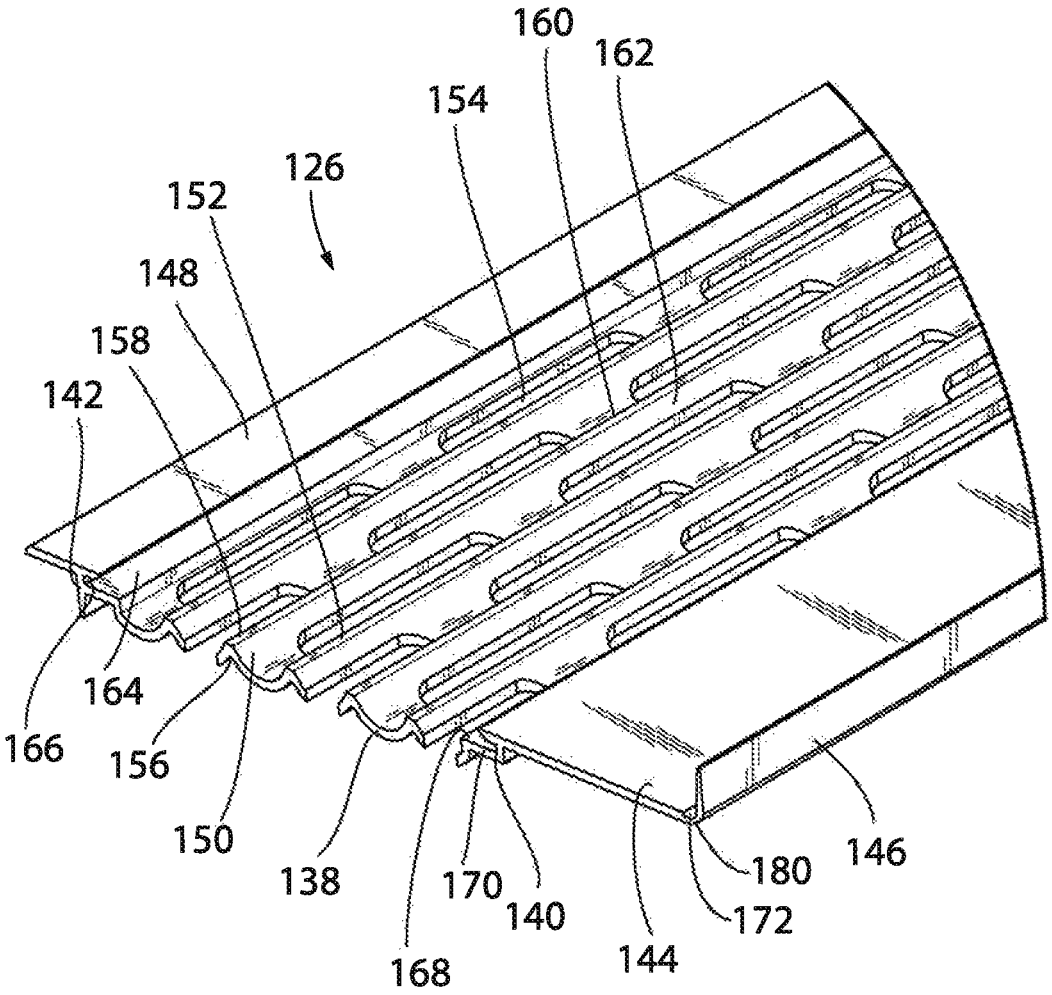
FIG. 4 is a top perspective view of a section of a frame of the gutter debris barrier system constructed in accordance with a second embodiment of the invention and having a living hinge.

FIG. 4 shows a different embodiment of a frame 126 from that shown in FIGS. 1-3. The various components of the frame 126 of this embodiment are designated by the same reference characters outlined above, incremented by 100. In this embodiment, the horizontal base portion 144 meets the first mounting flange 146 may be thicker than what is described above. For instance, the thickness of the horizontal base portion 144 may be consistent across the length of the horizontal base portion 144, and the first mounting flange 146 may have substantially the same thickness. For instance, the thickness of both the horizontal base portion 144 and the first mounting flange 146 may be between 0.04-0.08 inches and, more typically, 0.06 inches. Additionally, the first mounting flange 146 may taper from the initial thickness of 0.06 inches to a thinner thickness. In order to still accommodate the desired level of flex in the frame 126, a living hinge 172 may be provided. The living hinge 172 may be located where the horizontal base portion 144 meets the first mounting flange 146. As shown, the living hinge 172 features a cutout located at this intersection, where the cutout has a thickness. By way of example, the cutout may result in a thickness of the living hinge 172 of 0.01-0.06 inches and, more typically, 0.045 As a result, the frame 126 still has the desired strength based on the thickness of both the horizontal base portion 144 and the first mounting flange 146, while the first mounting flange 146 still can flex and bend relative to the horizontal base portion 144. Of course, other living hinges could similarly be provided instead of or in addition to the living hinge 172. For instance, the living hinge could be a separate piece (not shown) that is mounted to the horizontal base portion 144, in which case the first mounting flange 146 could also be a separate part that is mounted to the base portion 144 by the living hinge. In this embodiment, the living hinge could be made of a different material that the remainder of the frame 126 that would enable the separate first mounting flange 146 to bend and flex relative to the horizontal base portion 144.

In any of the described embodiments, the first mounting flange 46 may be abutted against the fascia 18 of the building 12 and may be mounted to the fascia 18 by screws, bolts, rivets, or other suitable attachment devices that are inserted into openings 74 formed in the first mounting flange 46. Alternatively, the first mounting flange 46 may be secured to the fascia 18 using high-powered adhesive.

As shown, the first mounting flange 46 of this embodiment is spaced from the roof 16, however, the first mounting flange 46 could also be mounted closer to the roof 16 or could directly abut the roof 16. Additionally, a second mounting flange 48 is located at the outside of the frame 26 for mounting on the lip 34 on the outer wall 32 of the gutter 14 as shown in FIGS. 1 and 2.

A plurality of channels 50, six in the illustrated embodiment, extends longitudinally of the frame 26, with ribs 52 separating the channels 50. While the illustrated embodiment shows a frame 26 with six channels 50, additional or fewer channels 50 may be used as desired to accommodate different gutter 14 sizes and/or to form narrower or wider channels 50. Slots 54 are formed in the channels 50 for the passage of water into the underlying gutter 14. The slots 54 are generally oblong and extend longitudinally of the frame 26. As shown, slots 54 located in adjacent channels 50 are longitudinally offset from one another.

Each of the ribs 52 extends longitudinally along the length of the frame 26 between adjacent channels 50. Each of the ribs 52 extends from a base 56 defining the tops of the two adjacent channels 50 to a tip 58. Preferably the tips 58 are all located in the same plane. For instance, as shown, the ribs 52 may be truncated, resulting in flat upper tips 58 that lie in a common horizontal plane to form a planar surface on which the filter screen 28 lies. The tips 58 support the filter screen 28 and keep the filter screen 28 spaced from the floor 38 defined by the bottoms of the channels 50. This is important to maintain continued movement of water through the system 10. Once water passes through the filter screen 28, it can drop directly into the channels 50 or flow down the ribs 52 and drip through the slots 54 into the bottom 24 of the gutter 14. Because the ribs 52 of the frame 26 contact the filter screen 28, the water experiences capillary action and moves downwardly along the rib 52 and eventually through the slots 54 into the gutter 14. This capillary action occurs along the entire length of the system, inhibiting or preventing the formation of unsightly tiger strips that would occur if water were to flow over the outer edge of the gutter 14.

The channels 50 are generally tapered as a result of the configuration of the ribs 52. In the illustrated embodiment, the channels 50 are arcuate in shape, and more specifically U-shaped. Each rib 52 has first 60 and second 62 opposed surfaces, both of which slope curvilinearly downwardly and outwardly for at least a portion of the height of the rib 52 so as to form parts of adjacent channels 50. Alternatively, the channel 50 could be generally V-shaped or X-shaped. Alternatively still, the ribs 52 may extend from a flat floor at an angle such that the channel 50 formed therein is tapered. Other configurations of channels 50 and ribs 52 are possible, which form other embodiments of tapered channels.

The tapered structure of the channels 50 provides several benefits over comparable gutter guards having vertical ribs and planar channels. First, the tapered structure of the channels 50 and the ribs 52 helps to funnel moisture towards the slots 54. The combination of tapered channels 50 and ribs 52 and the location of the slots 54 at the bottom of the channels 50 helps to ensure that all water is funneled through the frame 26 and into the gutter 14. Previous gutter guards having channels with a flat floor and ribs that extend perpendicularly upward did funnel water down towards the frame floor, but not necessarily to the slots. Because the slots were spaced from the ribs in these previous embodiments, there was risk that water would pool along the right-angle edge of the channel. Tapered channels 50 help to alleviate this issue. Additionally, structures with curved surfaces are, everything else being equal, stronger than structures with sharp corners. Thus, by providing arcuate channels 50 and tapered ribs 52, the frame 26 is stronger and can withstand greater forces thereon than comparable prior art frames.

The illustrated embodiment features ribs 52 with an approximate height from base 56 to tip 58 between 0.10 to 0.35 inches and more preferably approximately 0.155 inches. In another embodiment, the approximate height from the base 55 to the tip 58 is preferably approximately 0.216 inches. Typically, ribs in previous gutter guard systems were typically 0.250 inches in height or higher. Each of the U-shaped channels 50 have an approximate upper radius on the top side of the floor 38 about the center of the channel 50 between 0.100-0.350 inches and more preferably approximately 0.227 inches, and a lower radius beneath the floor 38 about the center of the channel 50 between 0.200-0.400 inches, and more preferably approximately 0.288 inches. Consequently, the typical thickness of the floor 38 is approximately 0.050-0.150 inches and more preferably 0.061 inches. As shown, each channel 50 has a width from tip 58 to adjacent tip 58 of between approximately 0.300 and 0.700 inches and more preferably 0.512 inches.

Referring to FIG. 2, the first, inner side wall 40 of the frame 26 may each include a shelf 64 with a slot 66 configured to accommodate a respective side 76 of the filter screen 28. Additionally, the second, outer side wall 42 may similarly include a shelf 68 and a slot 70 to accommodate an opposite side 78 of the filter screen 28. When installed in these slots 66, 70 the filter screen 28 rests on top of the shelves 64, 68 with its side edges retained in the slots 66, 70. Preferably, the shelves 64 are in the same plane as the tip 58 of each rib 52, such that the filter screen 28 can lie flat across the ribs 52 and on top of the shelves 64. The filter screen 28 may then be held in place within the slots 66 using adhesive glue, other attachment devices, or even by crimping. Preferably, a rubberized adhesive (not shown) is used, for instance Dow Corning® 791 weather proofing sealant, which expands and contracts with temperature fluxuation. As a result, the filter screen 28 remains tight against the frame 26 regardless of temperature variations.

A variety of filter screens 28 may be used with the illustrated invention. Preferably, the filter screen 28 is made of a woven stainless-steel wire material that is flexible to allow the filter screen 28 to be spread over the frame 26. Varying grades of stainless steel can be used, for instance 316 or 410 stainless steel alloy. The filter screen 28 collects water, at which point the water experiences capillary action and drops through the filter screen 28. This encourages movement of the water down through the openings in the filter screen 28 and into the gutter 14. The openings in the filter screen 28 should be sufficiently small to prevent debris from entry into the gutter 14, while still allowing sufficient water flow to the gutter 14.

Typically, the debris barrier system 10 will be installed in five-foot length segments, although other sized segments could be used depending on the exterior layout of a building 12. During installation, a section of the frame 26 is prepared for installation by laying the filter screen 28 along the tips 58 of the ribs 52 and the shelves 64. The sides of the filter screen 28 are then inserted into the slots 66 and secured in place using adhesive as described above. Preferably, the filter screen 28 extends longer than the length of the frame 26 so that at least two inches of the filter screen 28 can be bent down on either end of the frame 26 segment. Next, the frame 26 is located about the gutter 14, and thereafter the first mounting flange 46 is installed to the fascia 18. Once the first mounting flange 46 is fastened to the fascia 18, the second mounting flange 48 can be attached to the lip 34 on the outer wall 32 of the gutter 14.

If desired, the frame 26 can be bent about a pivot point 80 where the first mounting flange 46 and horizontal base portion 44 intersect to ensure that the second mounting flange 48 can be securely attached to the lip 34. By way of example, the first mounting flange 46 may be bent at least 15 degrees relative to the frame. The first mounting flange 46 can be further bent at least 20 degrees relative to the frame. When the next segment is installed, it will tightly abut the edge of the adjacent section.

It should be understood that the components of the system may be made of any number of different materials. As shown and described, many of these components are made of heat-conductive materials, such as aluminum. This encourages heat transfer about the frame and the filter screen, especially where the system includes a heating element (not shown). Other materials could be used to improve the durability, strength, or conductivity of the component. Additionally, while the above description outlines possible attachment devices, it should be noted that any of the components can be attached to one another using screws, bolts, clips, rivets, nails, set-screws, tape, glue, adhesive, and the like.

Additionally, it should be understood that the various inventive features described above can each be used independently of one another or in combination with other features.

It is appreciated that many changes and modifications could be made to the invention without departing from the spirit thereof. Some of these changes will become apparent from the appended claims. It is intended that all such changes and/or modifications be incorporated in the appending claims.

I claim:

1. A debris barrier system for use with a gutter configured to collect water, the gutter having a bottom, a first inner wall located adjacent to a fascia building surface that extends downwardly from a roof of a building, and a second wall spaced outwardly from the first wall, the debris barrier comprising:

a frame made of metal and comprising:

a base portion having a first side and a second side;

of a plurality of ribs extending from the base portion to of a plurality tips extending in a common plane with one another; and a first mounting flange extending from the first side of the base portion; and a filter screen covering at least a portion of the frame, the filter screen resting on the plurality of tips in the common plane, the filter screen capable of allowing water to flow therethrough while precluding debris from passing therethrough;

wherein the frame is adopted to overlie at least a portion of the gutter;

wherein the first mounting flange of the frame is configured to be fastened directly to the fascia building surface;

wherein the first mounting flange has an uppermost end portion that terminates at a free upper end, wherein the uppermost end portion of the first mounting flange is configured to be located above an uppermost edge of the gutter and to receive fasteners that fasten the mounting flange directly to the fascia building surface above the uppermost edge of the gutter;

wherein the free upper end is adapted to be vertically spaced from the roof of the building; and wherein the second side of the frame is configured to be mounted to the gutter.

2. The debris barrier system of claim 1, wherein the first mounting flange is configured to extend at an angle of at least 75 degrees relative to the bottom of the gutter.

3. The debris barrier system of claim 1, wherein the base portion is a horizontal base portion extending from the second side of the frame to the first mounting flange.

4. The debris barrier system of claim 3, further comprising a living hinge located where the first mounting flange extends from the horizontal base portion.

5. The debris barrier system of claim 3, wherein a thickness of the horizontal base portion decreases progressively from a first thickness at the first side of the frame to a second thickness at the first mounting flange.

6. The debris barrier system of claim 5, wherein the thickness of the first mounting flange is substantially equal to the second thickness.

7. The debris barrier system of claim 3, wherein the second side of the frame comprises a second mounting flange extending from the second side of the frame and configured to lie substantially parallel with the bottom of the gutter; and wherein the second mounting flange is configured to be fastened to the second wall of the gutter.

8. The debris barrier system of claim 3, wherein the first mounting flange is bendable relative to the frame; and wherein the first mounting flange can bend at least 15 degrees from an initial, resting position.

9. The debris barrier system of claim 8, wherein the first mounting flange can bend at least 20 degrees from an initial resting position.

10. The debris barrier system of claim 3, wherein the frame further comprises;

a floor configured to extend longitudinally of the gutter;

at least two longitudinally extending, laterally spaced tapered channels extending along the floor between the first side and the second side, the tapered channels being separated from one another by a longitudinally extending rib that extends upwardly from the floor, each of the tapered channels having a plurality of slots formed in the floor, wherein the rib has first and second opposed surfaces, each of which slopes curvilinearly downwardly and outwardly along at least a portion of the height thereof.

11. A debris barrier system for use with a gutter configured to collect water, the gutter having a bottom, a first inner wall located adjacent to a fascia that extends downwardly from a roof of a building, and a second wall spaced outwardly from the first wall, the debris barrier system comprising:

a metal frame that overlies at least a portion of the gutter;

wherein the frame has:

a floor;

a plurality of slots formed into the floor; a plurality of ribs extending from the floor to a plurality of tips extending in a common plane with one another;

a first, inner side wall;

a first mounting flange that extends from the first, inner side wall substantially perpendicular to the floor to a location directly above an uppermost edge of the first inner wall of the gutter, the first mounting flange being attached directly to a building fascia;

a second, outer side wall; and a second mounting flange extending from the second, outer side wall substantially parallel to the floor and being fastened to the second wall of the gutter;

all of which extend longitudinally of the gutter; and a filter screen covering at least a portion of the frame, the filter screen capable of allowing water to flow therethrough resting on the plurality of tips in the common plane, and the filter screen being while precluding debris from passing therethrough;

wherein the frame is attached to the building fascia and the second wall of the gutter such that the frame is held over the bottom of the gutter.

12. The debris barrier system of claim 11, wherein the frame further comprises a horizontal base portion that extends from the first, inner side wall to the first mounting flange.

13. The debris barrier system of claim 12, further comprising a living hinge located where the first mounting flange extends from the horizontal base portion.

14. The debris barrier system of claim 12, wherein the horizontal base portion abuts the first, inner side wall at a first end;

wherein the horizontal base portion abuts the first mounting flange at a second end; and wherein the thickness of the horizontal base portion at the first end is greater than the thickness of the horizontal base portion at the second end.

15. The debris barrier system of claim 14, wherein the thickness of the first mounting flange is approximately 0.045 inches.

16. The debris barrier system of claim 15, wherein the first mounting flange is bendable relative to the frame; and wherein the first mounting flange can bend at least 20 degrees from an initial resting position.

17. The debris barrier system of claim 1, wherein the first mounting flange is adapted to be located vertically above the uppermost edge of the gutter.

18. The debris barrier system of claim 11, wherein the first mounting flange is configured to be located closely adjacent to and in vertical alignment with the uppermost edge of the gutter.

* * * * *